United States Patent [19]

Moriarty et al.

[11] Patent Number: 4,979,543

[45] Date of Patent: Dec. 25, 1990

[54] PIN SEAMED PLANAR PRESS FABRIC

[75] Inventors: Michael G. Moriarty, Ballston Lake; Paul F. Hood, Glenmont, both of N.Y.; Ricahard E. Humphreys, King George, Va.

[73] Assignee: Albany International Corp., Albany, N.Y.

[21] Appl. No.: 438,102

[22] Filed: Nov. 16, 1989

[51] Int. Cl.[5] ..... D03D 13/00

[52] U.S. Cl. ..... 139/383 AA; 428/223; 428/280; 428/282; 428/192; 162/DIG. 1; 162/348; 162/358

[58] Field of Search ..... 139/383 AA, 383 A; 428/223, 280, 282, 192; 162/DIG. 1, 358, 348

[56] References Cited

U.S. PATENT DOCUMENTS

| | | | |
|---|---|---|---|
| 3,815,645 | 6/1974 | Codorniu | 139/383 AA |
| 4,267,226 | 5/1981 | Kohler et al. | 428/223 |
| 4,555,440 | 11/1985 | Crook | 428/223 |
| 4,863,786 | 9/1989 | Green et al. | 139/383 AA |
| 4,865,083 | 9/1989 | Cunnane | 139/383 AA |

*Primary Examiner*—Andrew M. Falik

*Attorney, Agent, or Firm*—Kane, Dalsimer, Sullivan, Kurucz, Levy, Eisele and Richard

[57] ABSTRACT

A dress fabric comprising a plurality of layers of machine direction and cross-machine direction yarns, respectively, the yarns for each layer oriented in parallel with respect to each other and perpendicular with respect to the yarns of immediately adjacent layers, the yarns of one layer not binding the yarns of adjacent layers, and separate binder yarns for binding said layers. The fabric defines two machine direction oriented edges and two cross-machine direction oriented edges, whereby at each cross-machine direction oriented edge certain machine direction yarns extend from one layer a distance sufficient to form a loop and then return to the same cross-machine direction oriented edge into another layer of machine direction yarns.

5 Claims, 2 Drawing Sheets

PIN SEAMED PLANAR PRESS FABRIC

FIELD OF THE INVENTION

This invention relates to press fabric. More particularly, this invention relates to press fabric comprising pin seamed planar press fabric.

BACKGROUND OF THE INVENTION

A major portion of the art of paper making consists of sequential stages in which water is removed from a paper web. These various stages are differentiated by the different methods used to remove the water from the web. One such method is to provide a press fabric for contacting the web while the fabric and the web are passed through a high pressure region formed by a press nip. During this process water pressed out of the web is forced into and through the press fabric.

It has long been recognized that an ideal press fabric must be permeable to water, must resist compaction, and must maintain its dimensional stability. Although woven and non-woven fabrics have been suggested as press fabrics, improved results are continuously sought. An embodiment of a multilayer press fabric is described in U.S. Pat. No. 4,555,440, incorporated herein by reference.

Another aspect of useful press fabrics is that they can have a seam which allows faster, safer, and easier installation on a papermaking machine. Various methods of seam construction are known in the art, one advantageous arrangement of forming seams comprising a pin seam arrangement whereby machine direction loops in respective ends to be joined together are engaged by a cross-machine direction member. See, for example, U.S. Pat. Nos. 2,907,093, 3,281,905, 3,316,599, 4,250,822, 4,267,226, 4,344,209, and 4,601,785, all of which are incorporated herein by reference. Such seam arrangements have the disadvantages that they can cause marking of the paper sheet and that there may be loud popping noises when the seams pass over a suction box.

OBJECTS OF THE INVENTION

It is an object of the invention to provide a novel press fabric.

It is also an object of the invention to provide a novel type of pin seamed planar press fabric.

It is a further object of the invention to provide this novel type of pin seamed press fabric comprising a plurality of layers of machine direction and cross-machine direction yarns, respectively, the yarns for each layer oriented in parallel with respect to each other and perpendicular with respect to the yarns of immediately adjacent layers, the yarns of one layer not binding the yarns of an adjacent layer, and separate cross-machine direction oriented binder yarn for binding said layers, the fabric defining two machine direction oriented edges and two cross-machine direction oriented edges, whereby at each cross-machine direction oriented edge certain machine direction oriented yarns extend from one layer a distance sufficient to form a loop and then return to the same cross-machine direction oriented edge into another layer of machine direction oriented yarns.

These and other objects of the invention will become more apparent in the discussion below.

DETAILED DESCRIPTION OF THE INVENTION

Applicants have developed a novel construction for a press fabric which facilitates seaming. According to the invention, a press fabric comprises a plurality of layers of machine direction oriented and cross-machine direction oriented yarns, respectively, the yarns for each layer oriented in parallel with respect to each other and perpendicular with respect to the yarns of immediately adjacent layers. The yarns of one layer do not bind the yarns of adjacent layers, and separate cross-machine direction oriented binder yarns bind said layers. The fabric defines two machine direction oriented edges and two cross-machine direction oriented edges, whereby at each cross-machine direction oriented edge certain machine direction yarn extend from one layer a distance sufficient to form a loop and then return to the same cross-machine direction oriented edge into another layer.

More particularly, the press fabric of the invention comprises a weave pattern in which parallel machine direction oriented (MD) filling yarns and cross-machine direction oriented (CD) warp yarns are held together by CD binder yarns. The filling yarns and the warp yarns are in three alternating layers, and preferably the layers comprise top and bottom layers of MD filling yarn and an intermediate layer of CD warp yarn. At each CD edge a filling yarn extends out and back into another layer to form a loop, the yarn returning at a point perpendicular to the layer from which it extended.

The filling yarns would preferably comprise the top and bottom layers in a 3-layer, or triplanar, fabric. In the 3-layer fabric a loop would begin at the top layer and finish at the bottom layer.

Figure 1:
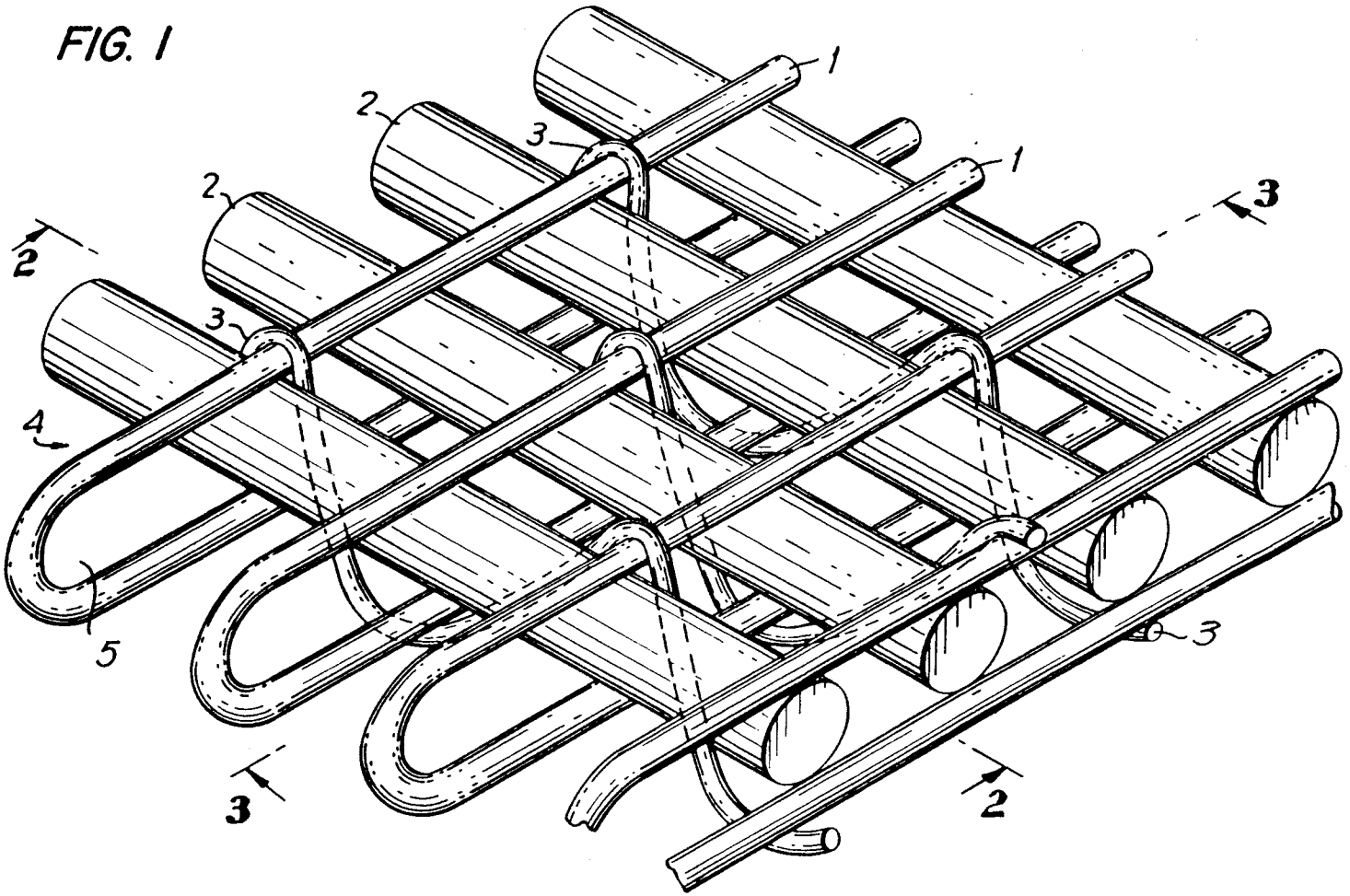
FIG. 1 represents a perspective view of a portion of a pin seamed press fabric comprising an embodiment of the invention.

The invention can perhaps be better understood by making reference to the drawings. According to FIG. 1, MD filling yarns 1, arranged in parallel, form top and bottom layers, and CD warp yarns 2, arranged in parallel, form an intermediate layer. The CD wrap yarns 2 may be of a resilient material, so that the intermediate layer formed therefrom may be a shockabsorbing layer. Yarns 1 and 2 are held together by CD binder yarns 3, which alternate from top to bottom. CD binder yarns 3 may comprise threads which are thinner than MD filling yarns 1. At CD edge 4, yarns 1 form loops 5.

Figure 2:
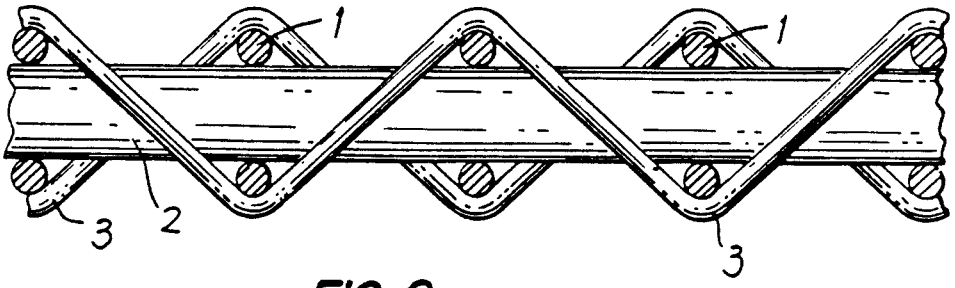
FIG. 2 represents a partial cross-sectional view in the machine direction of a portion of an embodiment of the invention.
Figure 3:
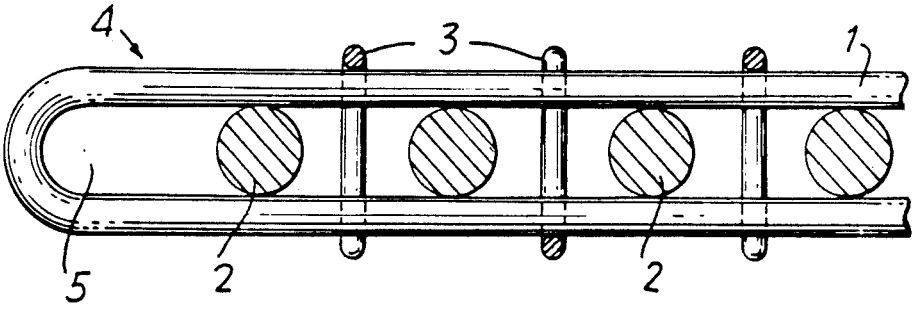
FIG. 3 represents a partial cross-sectional view in the cross-machine direction of one end of a portion of the embodiment of the invention shown in FIGS. 1 and 2.

FIGS. 2 and 3 show an embodiment of the invention in different perspectives. FIG. 2 is an MD cross-sectional view of a cross-machine section in which the alternating weave of binder yarns 3 can be appreciated. FIG. 3 represents a CD cross-sectional view of a machine direction section of a press fabric according to the invention.

The dimensions of the loops 5 as well as the materials employed in yarns 1, 2, and 3 are well known to those in the art. Reference can be made, for example, to the United States patents cited above as well as to *Paper Machine Felts and Fabrics*, Albany International Corp. (1976), incorporated herein by reference.

The above-disclosed press fabric has a number of desirable physical characteristics. For example, each layer provides a support platform which supports the other layers while the fabric is passed through a press nip. As a result, the fabric is able to withstand numerous, repetitive compression cycles before the caliper deteriorates to a point where it can no longer handle water. In other words, the fabric exhibits relatively high compaction resistance, and at the same time the physical construction of the fabric insures its dimensional stability. Furthermore, it is well known that "knuckles", formed when one yarn changes levels or is partially wrapped around another yarn in woven fabrics, are uneven, high-pressure points which may cause marks in a sheet of paper. Since the present fabric lacks "knuckles", its useful life is much longer and sheet marking is reduced. Also, popping noises that occur when a seam passes over a suction box are reduced or eliminated due to the uniformity between the body of the fabric and the seam area.

The yarn forming the individual layers are spaced to form an open fabric. The interstices formed between these yarns enable the fabric to accept relatively large amounts of water from a paper web.

Figure 4:
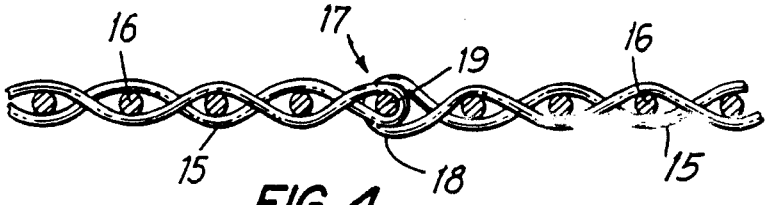
FIG. 4 PRIOR ART
FIG. 4 represents a partial cross-sectional view in the cross-machine direction of a portion of a prior art fabric seam construction.

Another key advantage of the press fabric according to the invention is that the particular structure of the planar fabric allows formation of a seam area which for all intents and purposes is like the body of the fabric. FIG. 4, for example, shows a typical, known seamed press fabric including the seam area. The base yarns 15 and 16 in the body all interweave. The seam area 17 consists of loops 18 of MD yarns 15 with a pintle or pintles 19 used to connect the body of fabric. The pintle 19 extends all the way across to each edge of the fabric without interweaving. Therefore, the seam area is structurally different from the body of the fabric, which leads to nonuniform water removal and sheet marks. The thickness of the seam area is usually greater than the body by a significant amount, thereby further increasing chances of objectionable seam marks as the fabric/sheet pass through the press nip.

In the planar construction according to the invention, the body consists of MD and CD yarns that are not interwoven. The seam area where the pintle extends between an upper and lower yarn is therefore similar to the body of the fabric in terms of yarn construction and geometry and thickness under load.

Thus, according to the invention all the advantages of a planar fabric can be achieved while the advantages of a seam are incorporated. In fact, the planar fabric herein itself tends to be the best type of woven base for seaming in terms of physical and structural make-up.

To demonstrate the advantages of the invention, measurements were taken of seam thickness of press fabric according to the invention and known press fabrics. The results are set forth in the following table:

TABLE

BODY THICKNESS vs. SEAM THICKNESS

| Sample | MD Yarn (in.) | CD Yarn (in.) | Base Caliper (in.) | Base Caliper at 500 Psi Load | Seam Caliper 0.016 in. Dia. Pintle | Seam Caliper 0.027 in. Dia. Pintle | Seam Caliper 0.040 in. Dia. Pintle |
|---|---|---|---|---|---|---|---|
| A* | 0.016 | 0.016 | 0.048 | 0.046 | 0.047 | — | — |
| B | 0.016 | 0.016 | 0.080 | 0.044 | 0.054 | — | — |
| C | 0.016 | 0.016 | 0.080 | 0.044 | — | 0.059 | — |
| D | 0.016 | 0.016 | 0.080 | 0.044 | — | — | 0.072 |
| E* | 0.016 | 0.027 | 0.059 | 0.057 | — | 0.057 | — |
| F | 0.032 plied mono | 0.016 plied mono | 0.094 | 0.043 | 0.068 | — | — |
| G | 0.032 plied mono | 0.016 plied mono | 0.094 | 0.043 | — | 0.091 | — |
| H | 0.032 plied mono | 0.016 plied mono | 0.094 | 0.043 | — | — | 0.102 |
| I* | 0.032 plied mono | 0.016 plied mono | 0.080 | 0.068 | 0.068 | — | — |
| J | 0.016 | 0.016 | 0.111 | 0.060 | — | 0.059 | — |
| K | 0.016 | 0.016 | 0.111 | 0.060 | — | — | 0.072 |

*According to the invention

As shown in the table, the body caliper of each sample according to the invention was about the same as that of the seam. Samples J and K were triple-layer fabrics that exhibited substantial caliper reduction under load. These were the only instances of prior art fabric where the seam thickness and body thickness were similar; however, it should be noted that the geometry, i.e., structure, of the seam is still significantly different from that of the body.

The above table shows the relationship between the seam thickness of regular seamed press fabrics and the seam thickness incorporating the planar fabric with a seam. It is understood that all base fabrics compact, i.e., lose thickness, over time as they are exposed to repeated compressions in the nip. Also, planar bases resist this compaction and retain more of their initial thickness. Thus, seam thickness is basically equal to the sum of the diameters of the pintle and two MD yarns. Seam thickness loss will accordingly be determined primarily by the reduction in yarn caliper, not due to weave. That is why seams are thicker in new and certain used press fabrics.

There are further advantages to the press fabric described herein. With regard to the loops at the CD edges, the loops are more in line with the fabric surfaces, i.e., have a lower profile, than are loops prepared according to other techniques involving interweaving of the MD and CD yarn systems. Also, the loop length and diameter can be more easily varied or controlled. Another advantage is that there may be better batt bonding due to the presence of the multifilament binder.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A press fabric for dewatering a moist paper web comprising first, second, and third layers, each layer comprising a plurality of unwoven, parallel, coplanar yarns, the yarns of said first and third layers extending in the machine direction and the yarns of the second layer extending in the cross-machine direction, the yarns of one layer being unbound by the yarns of any adjacent layer, and separate binder means for binding said layers, the fabric defining two machine direction oriented edges and two cross-machine direction oriented edges, whereby at each cross-machine direction oriented edge certain machine direction yarns from the first layer extend a distance sufficient to form a loop and then return into the third layer.

2. The press fabric of claim 1, wherein said binder means comprises threads which are passed through said layers between said first layer and said third layer.

3. The press fabric of claim 1, wherein the second layer is made of a resilient yarn to form a shock absorbing layer.

4. The press fabric of claim 1, wherein said binder means binds said first layer to other layers without any substantial knuckles.

5. The press fabric of claim 4, wherein said binder means comprises a thread thinner than the yarns of said first layer.

* * * * *

UNITED STATES PATENT AND TRADEMARK OFFICE

CERTIFICATE OF CORRECTION

PATENT NO. : 4,979,543

DATED : December 25, 1990

INVENTOR(S) : Michael G. Moriarty, Paul F. Hood, Richard E. Humphreys

It is certified that error appears in the above-identified patent and that said Letters Patent is hereby corrected as shown below:

Cover page, Item [75], delete "Ricahard" and substitute therefor —Richard—.

Signed and Sealed this

Twelfth Day of May, 1992

*Attest:*

*Attesting Officer*

DOUGLAS B. COMER

*Acting Commissioner of Patents and Trademarks*

UNITED STATES PATENT AND TRADEMARK OFFICE

CERTIFICATE OF CORRECTION

PATENT NO. : 4,979,543

DATED : December 25, 1990

INVENTOR(S) : Michael G. Moriarty, Paul F. Hood, Richard E. Humphreys

It is certified that error appears in the above-identified patent and that said Letters Patent is hereby corrected as shown below:

Title page, Item [57], line 1, delete "dress" and substitute therefor —press—.

Signed and Sealed this

Fourteenth Day of July, 1992

*Attest:*

DOUGLAS B. COMER

*Attesting Officer*

*Acting Commissioner of Patents and Trademarks*